US005833130A

United States Patent [19]

Correll

[11] Patent Number: 5,833,130

[45] Date of Patent: Nov. 10, 1998

[54] MULTI-FUNCTION PIZZA CARTON

[76] Inventor: John D. Correll, 8459 Holly Dr., Canton, Mich. 48187

[21] Appl. No.: 731,586

[22] Filed: Oct. 16, 1996

Related U.S. Application Data

[63] Continuation-in-part of Ser. No. 278,258, Jul. 21, 1994, Pat. No. 5,586,716, which is a continuation of Ser. No. 86,318, Jul. 6, 1993, abandoned, and a continuation of Ser. No. 311,396, Sep. 23, 1994, Pat. No. 5,713,509, which is a continuation of Ser. No. 86,318, Jul. 6, 1993, abandoned, and a continuation of Ser. No. 589,892, Jan. 23, 1996, Pat. No. 5,806,775.

[51] Int. Cl.[6] ..... B65D 5/20

[52] U.S. Cl. ..... 229/108; 229/104; 229/152; 229/178; 229/906

[58] Field of Search ..... 229/104, 108, 229/109, 110, 145, 152, 153, 178, 902, 906

[56] References Cited

U.S. PATENT DOCUMENTS

| | | | |
|---|---|---|---|
| 1,649,088 | 11/1927 | Tinsley | 229/108 |
| 2,608,340 | 8/1952 | Donnell . | |
| 4,111,306 | 9/1978 | Roccaforte . | |
| 4,260,060 | 4/1981 | Faller . | |
| 4,295,599 | 10/1981 | Locatelli et al. . | |
| 4,355,757 | 10/1982 | Roccaforte . | |
| 4,362,266 | 12/1982 | Webinger | 229/178 |
| 4,620,666 | 11/1986 | Lacasa et al. | 229/149 |
| 4,984,734 | 1/1991 | Zion et al. | 229/109 |
| 5,000,374 | 3/1991 | Deiger | 229/109 |
| 5,118,032 | 6/1992 | Gehd | 229/110 |
| 5,211,329 | 5/1993 | Patton | 229/178 |
| 5,351,880 | 10/1994 | Goudreau | 229/109 |
| 5,402,930 | 4/1995 | Storms et al. | 229/125.28 |
| 5,423,477 | 6/1995 | Valdman et al. | 229/104 |
| 5,531,373 | 7/1996 | Eisman | 229/108 |
| 5,549,241 | 8/1996 | Correll | 229/120.01 |
| 5,586,716 | 12/1996 | Correll | 229/178 |
| 5,713,509 | 2/1998 | Correll | 229/109 |

OTHER PUBLICATIONS

Photo 1: A Five–Sided Box, Photographer John Correll, Dec. 1, 1993.

Photo 2: The Blank for the Box Shown in photo 1, Photographer John Correll, Dec. 1, 1993.

*Primary Examiner*—Gary E. Elkins

[57] ABSTRACT

A versatile multi-function pizza carton capable of assuming a variety of configurations and of providing various features and functions. Specific disclosed structure includes double-panel V-walls, convertible side walls, convertible cover flaps, fall-back side walls, fall-back-wall retention means, wall-angling fold line, easy-tear corner fold line, and thermal-legs.

36 Claims, 5 Drawing Sheets

10
160
88
89
70
72
78
76
74
154
124
84
86
87
82
80
24
150
26b
44
81
38
26a
20
39
36
45
110a
110b
37
42
16
18a
18b
122
30
17a
17b
34
15
49
152
112a
112b
128
47
19a
19b
48
46
56a
56b
58a
58b
52a
61
60
59
64
62
52b
50

11
90a
92
90b
160
70
78
76
72
76
74
124
82
84
24
150
80
80
82
44
81
38
20
38
39
39
36
36
37
16
116
110a
114
110b
37
42
122
15
30
34
17a
17b
34
49
112a
19a
19b
118
119
114
116
112b
47
56a
56b
48
47
46
58a
58b
46
65
60
61
66
52a
52b
50

FIG-7
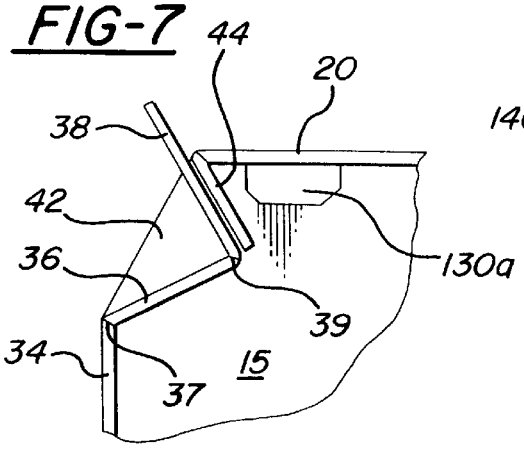
FIG-11
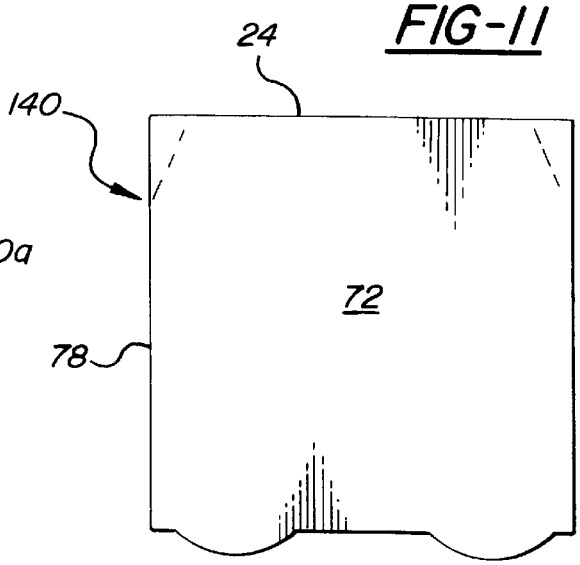
FIG-8
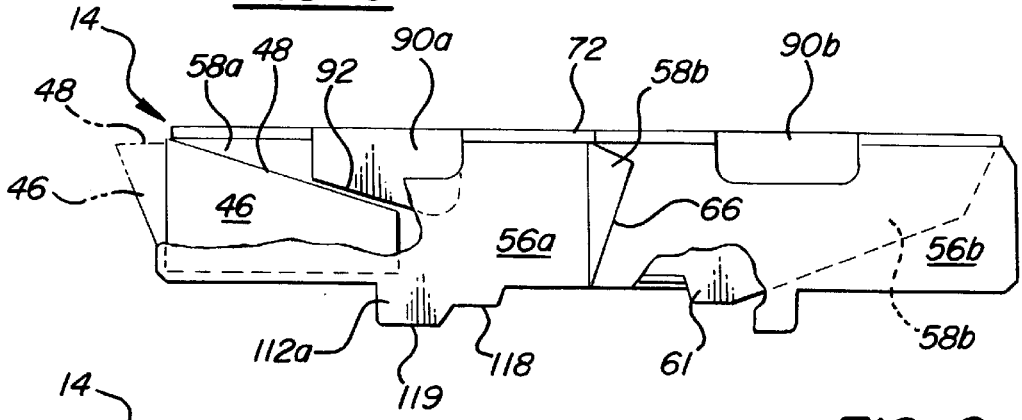
FIG-9
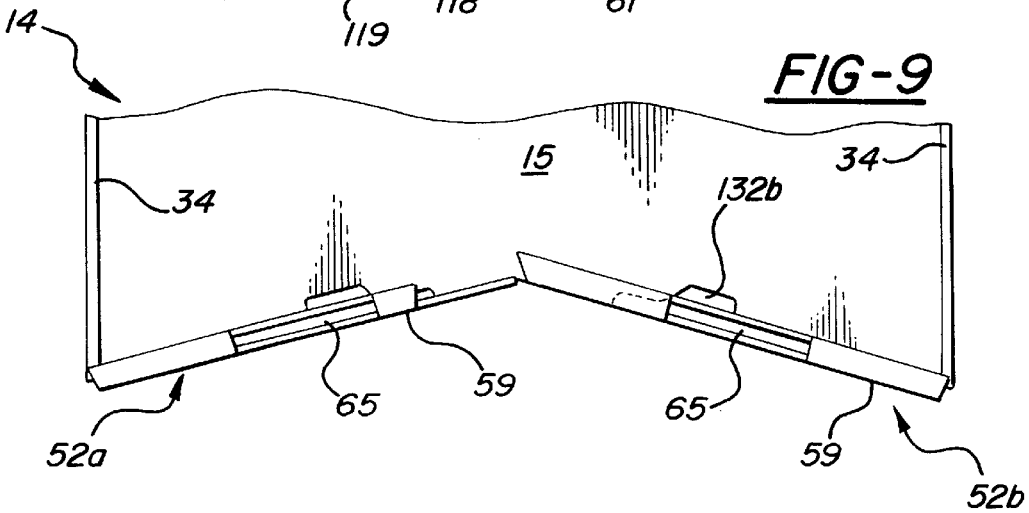
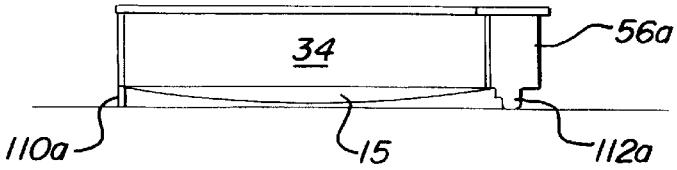
FIG-10

MULTI-FUNCTION PIZZA CARTON

CROSS-REFERENCES TO RELATED APPLICATIONS

This is a continuation-in-part of application Ser. No. 08/278,258, filed on Jul. 21, 1994, Now U.S. Pat. No. 5,586,716 which is a continuation of application Ser. No. 08/086,318 filed on Jul. 6, 1993 (now abandoned); application Ser. No. 08/311,396, filed on Sep. 23, 1994 Now U.S. Pat. No. 5,713,509 which is a continuation of application Ser. No. 08/086,318 filed on Jul. 6, 1993 (now abandoned); and application Ser. No. 08/589,892, filed on Jan. 23, 1996 Now U.S. Pat. No. 5,806,775.

FIELD OF THE INVENTION

This invention relates to cartons and, in particular, to blanks and boxes for round, relatively flat food products such as pizza and the like.

DESCRIPTION OF THE PRIOR ART

As the pizza industry has grown, there has developed a need for a pizza carton that can serve multiple functions and solve multiple problems. Specifically, it would be beneficial to have a carton that performs in the following ways.

First a carton should provide a material savings and, thereby, a cost savings over a traditional pizza box. While some prior art boxes do this, they often do it at a sacrifice to performance or structural integrity by replacing a double-panel front wall with a single-panel wall. So, there is a need for a box with a double-panel wall structure that also provides material and cost savings.

Second, the configuration of a carton should match the different operational needs among pizza companies as well as the changing needs of the same company. For example, some companies prefer a larger-size box cavity for packing extra items while others prefer angular walls that create a smaller cavity and retain the product in position. Still others want additional corner folds that provide extra stacking strength for stacking multiple cartons. In addition, some prefer to have the side flaps of a cover disposed inside the box cavity for ease of cover closure while others prefer to have them outside the cavity to avoid interference with the product. However, the structure of prior art cartons is such that they can be formed into one configuration only, thereby serving only one set of operational needs. So, there is a need for a carton that provides a choice of wall configurations and cover flap configurations, thereby serving multiple purposes and satisfying a broader range of pizza company needs.

Third, a carton should allow a pizza to be easily inserted into the box by the pizza-maker and allow for slices to be easily retrieved by the consumer. To accomplish this, the side walls of a box should fall back, or angle outward, when the box is open, but be maintained in vertical position when it's closed. With the prior art, this is accomplished with a folder style carton, or a box with unconnected corners. However, such a box may lack the structural integrity and stacking strength of a box with double-panel walls and connected corners. So, there is a need for a box with double-panel walls and connected corners which also has side walls that fall back when the box is open but are held in vertical position when it's closed.

Fourth, a box should allow for easy knockdown and disposal for the consumer. The prior art contains several pizza boxes designed for "easy disposal."However, they incorporate extra fold lines across the top and bottom panels of the carton, which may weaken the carton, and also may require the consumer to perform unusual techniques to knockdown the box. So, there is a need for an easy-to-knockdown carton that doesn't have added fold lines in the top and bottom panels and doesn't require unusual techniques to utilize.

Fifth, a box should be rigid and tight-feeling in order to convey a quality-product image. To accomplish this, the box should have a tight fit between side walls and cover side flaps. However, with the trend toward thinner corrugated flutes and lighter weight paper, the side walls of some pizza cartons tend to bow outward and the corners tend to be looser. So, there is a need for box that has a structure that reduces side wall bowing and maintains tight corners while being made of thinner, lighter board.

Sixth, a box should keep product heat loss to a minimum. In a packaged pizza, heat is lost three ways: (1) by infrared radiation emanating from the surface of the carton, (2) by convective air movement into and out of the carton and across the surface of the carton, and (3) by conduction through the bottom panel of the carton to a relatively cold support surface, such as a table. The prior art has attacked the heat retention problem by reducing heat loss in one or more of the above three ways. However, the result has been a carton that requires considerably higher production cost, or has some other drawback. So, there is a need for a box that provides reduced product heat loss, most notably through reducing the rate of conduction through the bottom panel, but that doesn't require increased material or production cost.

To satisfy the need for a box having a double-panel wall structure but which also provides material and cost savings, my invention discloses a double-section V-wall structure comprising adjacent first and second double-panel V-walls disposed at an angle greater than 120 degrees and less than 180 degrees. None of the prior art addresses this need, but the art that most closely resembles the structure includes Tinsley U.S. Pat. No. 1,649,088 granted on Nov. 15, 1927; Lacasa et al. U.S. Pat. No. 4,620,666 granted on Nov. 4, 1986; Geho U.S. Pat. No. 5,118,032 granted on Jun. 2, 1992; and a specialty box in the shape of a baseball home plate.

To satisfy the need for a carton that can be formed into a choice of wall configurations and cover flap configurations, my invention discloses a convertible side wall structure and convertible cover flap structure. None of the prior art addresses this need, but the art that most closely resembles the structure is Deiger U.S. Pat. No. 5,000,374 granted on Mar. 19, 1991.

To satisfy the need for a box with doublepanel walls and connected corners but which also has side walls that fall back when the box is open and are held in vertical position when the box is closed, my invention discloses fall-back side walls in combination with fall-back-wall retention means (i.e., type of cover flap structure) that interlocks with the front walls of the carton and holds the side walls in vertical position when the carton is closed. None of the prior art addresses this need the same way my invention does. The art that most closely resembles the structure includes Donnell U.S. Pat. No. 2,608,340 granted Aug. 26, 1952; Roccaforte U.S. Pat. No. 4,111,306 granted Sep. 5, 1978; and Locatelli et al. U.S. Pat. No. 4,295,599 granted Oct. 20, 1981.

To satisfy the need for an easy-to-knockdown carton that doesn't have added fold lines in the top and bottom panels and that doesn't require unusual techniques to knock down, my invention discloses an easy-tear corner flap fold line. While there is prior art pertaining to easy-to-dispose boxes, none of it uses the same approach or structure as my invention. As a result, there is no pertinent prior art.

To satisfy the need for a box that has a structure that reduces side wall bowing and maintains tight corners while being made of thinner, lighter board, my invention discloses a wall-angling fold line between adjoining walls. There is no pertinent prior art.

To satisfy the need for a box that provides reduced product heat loss, most notably through reducing the rate of conduction through the bottom panel, but that doesn't require increased material or production cost, my invention discloses thermal-legs that project downward underneath the bottom panel of the box. None of the prior art addresses this need with the same type of structure as my invention does, but the art most closely resembling the structure is Faller U.S. Pat. No. 4,260,060 granted on Apr. 7, 1981; Roccaforte U.S. Pat. No. 4,355,757 granted on Oct. 26, 1982; Zion et al. U.S. Pat. No. 4,984,734 granted on Jan. 15, 1991; Storms et al. U.S. Pat. No. 5,402,930 granted on Apr. 4, 1995; Valdman et al. U.S. Pat. No. 5,423,477 granted on Jun. 13, 1995; and Correll U.S. Pat. No. 5,549,241 granted on Aug. 27, 1996.

By satisfying the above needs, it would enable a pizza company to have a versatile, lower cost, higher performance package. These needs have not been satisfied by the prior art but are addressed by my invention. In conclusion, it would be highly desirable to provide a carton that overcomes the above-described needs and problems.

OBJECT AND ADVANTAGES

Accordingly, the general object of my invention is a cost-effective blank and related carton that can be adapted to multiple configurations and that offers multiple operational features and advantages.

More specifically, the object of my invention is a blank and related carton that does one or more of the following:

1) Provides a double-section V-wall structure that can be configured to conserve material over the typical single-section straight wall;
2) Provides unique box shape and extra corner space through an inverted V-wall structure;
3) Has fall-back-wall retention cover flaps that hold a movable fall-back side wall in vertical position when the box is closed;
4) Has a convertible side wall structure that comprises two adjacent panels that can be configured into a coplanar side wall structure or into an angled side wall structure;
5) Has a type of convertible cover side flap structure that can go inside the box or outside the box and can be adapted to accommodate a coplanar side wall structure or an angled side wall structure;
6) Has easy-tear corners;
7) Has a wall-angling fold line joining a side wall panel and an angular wall panel; and
8) Has thermal-legs that elevate the bottom panel of a loaded carton above a support surface and, thereby, reduce the rate of heat transfer (by conduction) from a hot product to the support surface.

The advantages of my invention are one or more of the following: (a) reduced material usage over a blank for a standard square pizza box, which allows for cost reduction, (b) unique carton shape with extra corner space, which allows for packing relatively large amounts of complementary items, (c) easy insertion and retrieval of pizza from the box cavity, (d) multiple carton shapes and wall configurations that can be derived from a single blank, which allows manufacturers and suppliers to provide multiple box styles and benefits with a single blank, (e) multiple carton closure options incorporated into a single box, which allows pizza operators to select the closure option that best suits their style of pizza, (f) unique cover shape options, which allows pizza companies to have a unique-looking carton, (g) easy knockdown and disposal resulting from an easy-tear corner flap, which enhances carton convenience for the end-user, (h) a tighter feeling and more rigid box, which enhances quality perception, and (i) elevation of the box off a support surface, which provides improved product heat retention.

Further objects and advantages of the invention will become apparent from consideration of the following detailed description, related drawings, and appended claims.

SUMMARY OF THE INVENTION

In accordance with the invention, a blank and related carton is created that incorporates one or more of the following structures:

1) Double-section V-wall structure, which is created in the preferred embodiments by a pair of adjacent double-panel walls disposed at an angle greater than 120 degrees and less than 180 degrees one to another, the angle being either interior or exterior, and having an inner panel of non-rectangular shape;
2) Fall-back-wall retention means that hold movable fall-back side walls in vertical position, the fall-back-wall retention means being created in the preferred embodiments by cover flaps that contact the fall-back side wall structures and, thereby, hold them in vertical position when the box is closed, a portion of the cover flaps in the embodiments being disposed between double panels of a double-panel front wall adjacent to the fall-back side wall structure;
3) Convertible side wall structure, which is created in the preferred embodiments by a structure that has a first wall panel attached to a bottom panel, a second wall panel attached to an end of the first wall panel and with an end aligned with a rear edge of the bottom panel, a third wall panel attached to the end of the second wall panel, a first connecting panel attached to a bottom edge of the second wall panel, and a second connecting panel attached to the first connecting panel and also attached to an end of a rear wall;
4) Convertible cover side flap structure, which is created in the preferred embodiments by a first side flap panel attached to a cover panel, a second side flap panel attached to a rear end of the first side flap panel, and a connecting panel attached to the second side flap panel and to the cover panel, the connecting panel having an edge free of attachment;
5) Easy-tear corner, which is created in the preferred embodiments by a corner flap attached to an end of a wall by an easily tearable perforated fold line having a short slit at the top of the fold line;
6) Wall-angling fold line, which is created in the preferred embodiments by a fold line joining a wall panel to another wall panel, the fold line being disposed at a non-perpendicular angle to a bottom edge of the wall panel;
7) Thermal-legs, which are created in the preferred embodiments by two pairs of projections extending downward from walls of the carton and which elevate the entire bottom panel of the carton above a support surface (such as a table), one pair of projections being positioned outside the box cavity in an angular wall configuration of the side wall structure and the other pair of projections having an irregular-shaped bottom edge, that bottom edge corresponding with an irregular-shaped opening in the bottom panel that receives a panel interlock tab projecting from the inner panel of a double-panel wall. My invention typically would be used for packaging relatively flat food products such as pizza; however, it could be used for other purposes, as well.

A complete understanding of the invention can be obtained from the detailed description that follows.

BRIEF DESCRIPTION OF THE DRAWINGS

FIG. 7 is a top view of a partial section of a carton with the side wall structure being in the third configuration.

FIG. 8 is a front view of a closed carton formed from the blank of the second embodiment.

FIG. 9 is a top view of a partial section of an open carton formed from the blank of the second embodiment.

FIG. 10 is a left side view of a carton formed from the blank of the first embodiment.

FIG. 11 is a top view of an alternate cover panel for the first embodiment.

LIST OF REFERENCE NUMERALS

Figure 1:
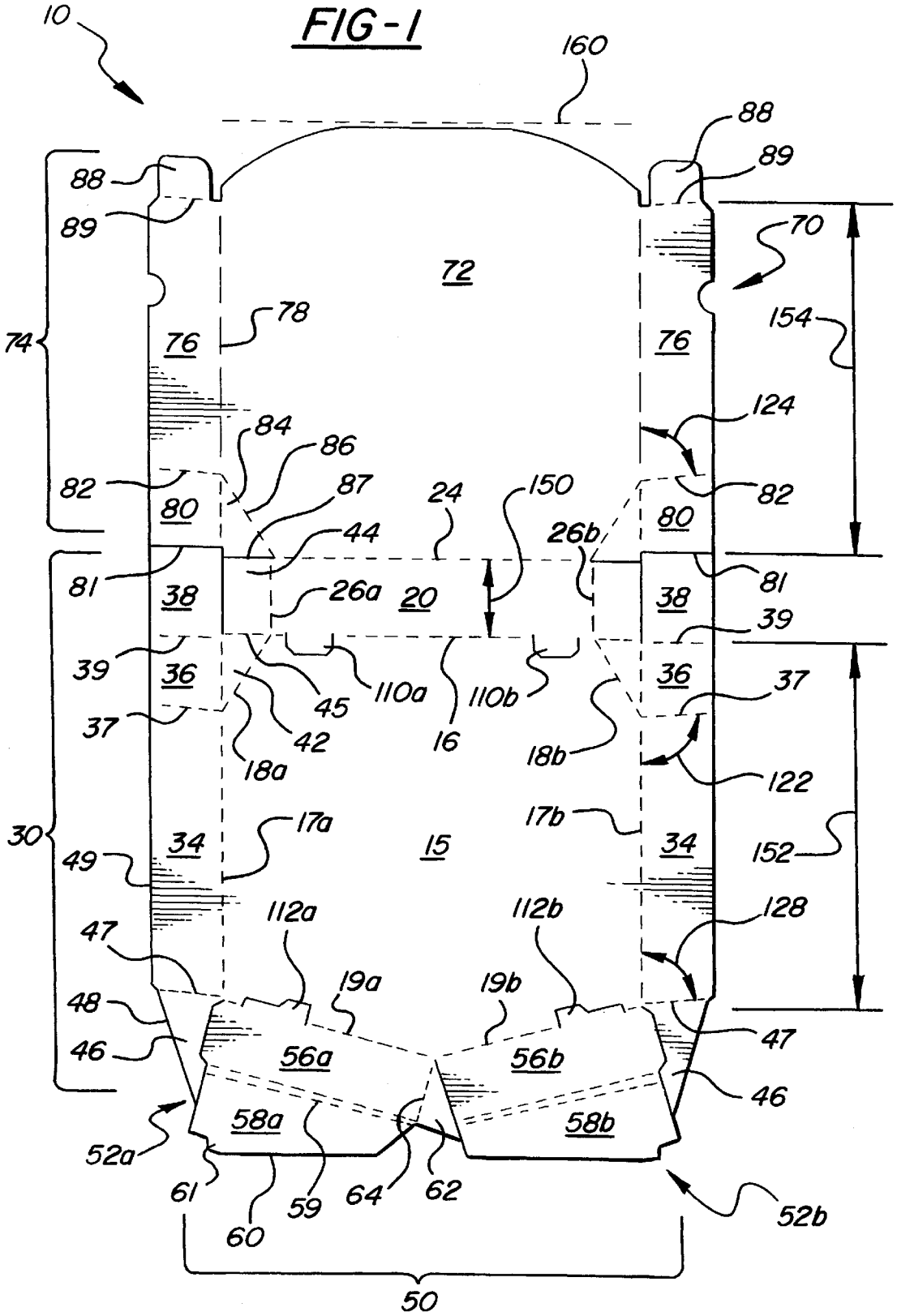
FIG. 1 is a plan view of a blank of the first preferred embodiment of the invention.

Within a drawing, closely related figures have the same number but different alphabetic suffixes. Between drawings, like reference numerals designate corresponding parts.

10 blank of first embodiment
11 blank of second embodiment
12 carton of first embodiment
13 carton of first embodiment
14 carton of second embodiment
15 bottom panel
16 rear edge (rear wall fold line) 17*a* first side edge (first side wall fold line)
17*b* second side edge (second side wall fold line)
18*a* first angular edge
18*b* second angular edge
19*a* first V-edge (first V-wall fold line)
19*b* second V-edge (second V-wall fold line
20 rear wall
24 top edge (cover fold line)
26*a* first end
26*b* second end
30 convertible side wall structure
34 first wall panel
36 second wall panel
37 first panel fold line
38 third wall panel
39 second panel fold line (panel end edge)
42 first connecting panel
44 second connecting panel
45 third panel fold line
46 corner flap
47 corner fold line
48 flap top edge
49 panel top edge
50 double-section V-wall structure
52*a* first V-wall
52*b* second V-wall
56*a* outer panel
56*b* outer panel
58*a* inner panel
58*b* inner panel
59 double-fold-lines
60 bottom edge of inner panel
61 panel interlock tab
62 center front flap
64 center front flap fold line
65 cover interlock opening
66 inside edge
70 cover
72 cover panel
74 cover side flap structure
76 first side flap panel
78 first side flap fold line
80 second side flap panel
81 rear edge
82 fold line (rear end of first side flap panel)
84 connecting panel
87 third edge
88 cover-to-front-wall interlock flap
89 interlock flap fold line
90*a* cover-to-front-wall interlock flap
90*b* cover-to-front-wall interlock flap
92 flap retention edge
101 short slit at top end
110*a* rear thermal-leg
110*b* rear thermal-leg
112*a* front thermal-leg
112*b* front thermal-leg
114 lowermost point
116 height of thermal-leg
118 lower portion
119 upper portion
120 angle of V-edges
122 non-perpendicular angle
124 non-perpendicular angle
126 acute angle
127 acute angle
128 acute angle
130*a* rear thermal-leg opening
130*b* rear thermal-leg opening
132*a* front thermal-leg opening
132*b* front thermal-leg opening
140 alternate cover panel
150 rear wall height
152 lateral front-to-rear bottom panel length
154 total front-to-rear side flap panel length

160 outermost front line
162 outermost top line

DESCRIPTION OF THE PREFERRED EMBODIMENTS

Referring now to the drawings, there is illustrated two preferred embodiments of the invention in blanks made of E-flute corrugated paperboard and, correspondingly, pizza cartons created from the blanks. It will be appreciated, as the description proceeds, that my invention may be realized in other embodiments and may be used in other applications.

Figure 2:
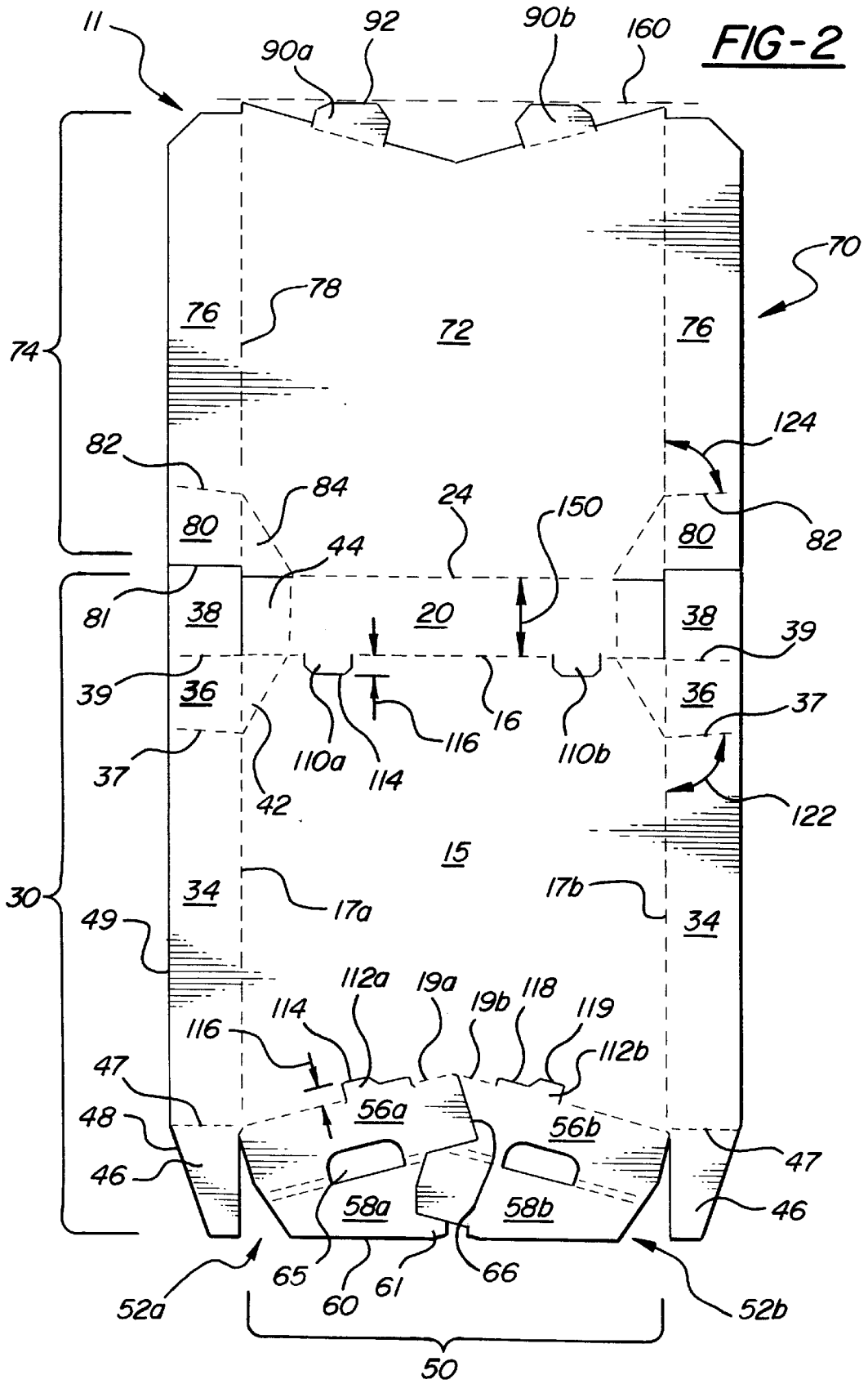
FIG. 2 is a plan view of a blank of the second preferred embodiment of the invention.
Figure 3:
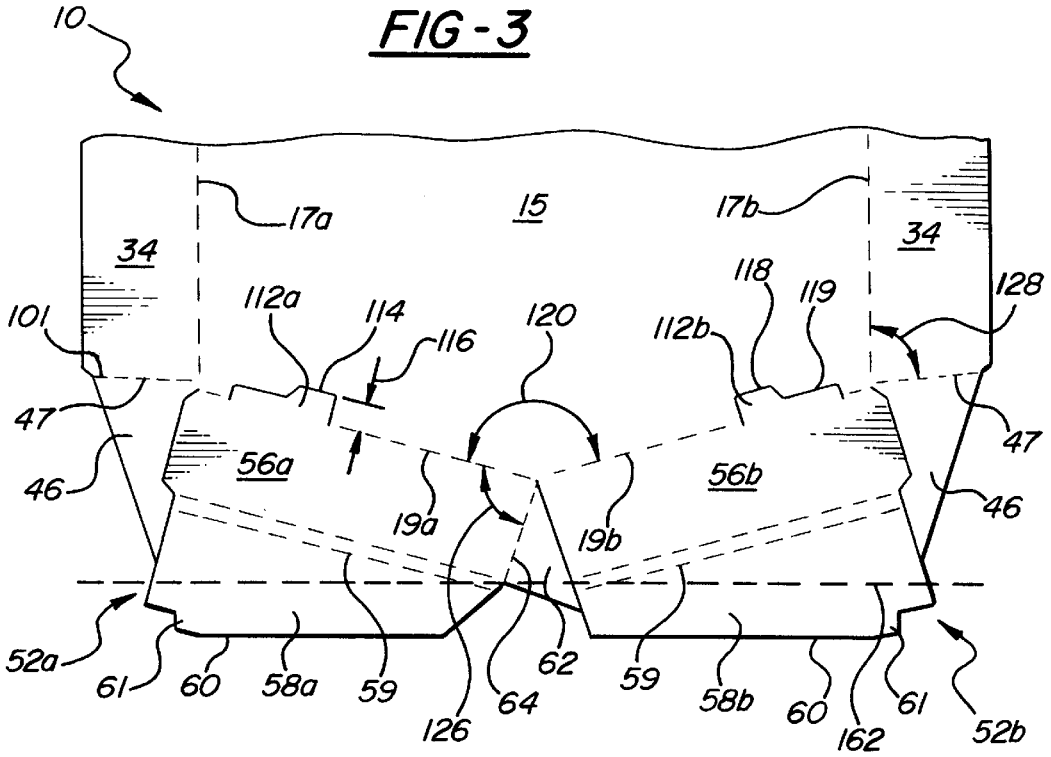
FIG. 3 is a plan view of a partial section of the blank of the first embodiment.
Figure 4:
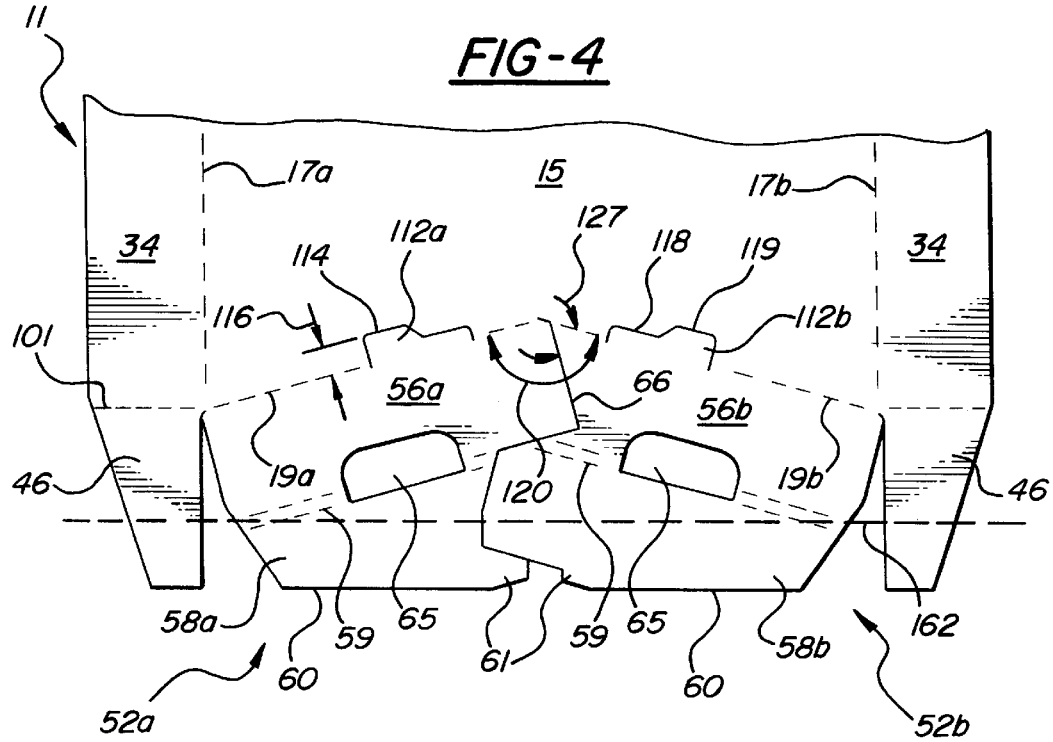
FIG. 4 is a plan view of a partial section of the blank of the second embodiment.

FIGS. 1 and 3 show blank 10, the first embodiment, and FIGS. 2 and 4 show blank 11, the second embodiment. The following discussion pertains to those blanks and also to the cartons formed from those blanks, shown in FIGS. 5 through 10. All parts are labeled in blank 10 (unless otherwise noted) and select parts are labeled in blank 11 and the carton drawings. It is understood that corresponding parts between drawings share the same reference numeral. Because the embodiments are, for the most part, bilaterally symmetrical, only parts on one side of a blank may be labeled. However, it is understood that a corresponding part on the other side is referenced by same numeral, although in some cases the numeral may have a different alphabetic suffix.

Structure of the Invention

Referring now primarily to FIG. 1, the base of the pizza carton is a bottom panel 15 which has a rear edge 16, parallel first and second side edges 17*a* and 17*b*, respectively, first and second angular edges 18*a* and 18*b*, respectively, and first and second front V-edges 19*a* and 19*b*, respectively. Together, the front V-edges form the front side of panel 15.

A rear wall 20 is hingedly attached to rear edge 16 by a rear wall fold line (also indicated by numeral 16). Wall 20 has a top edge 24 and first and second ends 26*a* and 26*b*, respectively. Wall 20 has a height 150 that extends between lines 16 and 24.

A pair of opposing convertible side wall structures 30 are hingedly attached to side edges 17*a* and 17*b* by a side wall fold line (also indicated by numeral 17*a* or 17*b*). Only the left side structure 30 is completely labeled, but the following discussion applies to the right side structure, as well. Structure 30 includes: (a) a first wall panel 34, (b) a second wall panel 36 hingedly attached to a rear end of panel 34 at a first panel fold line 37, (c) a third wall panel 38 hingedly attached to a panel end edge 39 of panel 36 by a second panel fold line (also indicated by numeral 39), (d) a first connecting panel 42 hingedly attached to a bottom edge of panel 36 and to angular edge 18*a* of panel 15, and (e) a second connecting panel 44 hingedly attached to panel 42 at a third panel fold line 45 and hingedly attached to end 26*a* of wall 20.

Lastly, structure 30 has a corner flap 46 hingedly attached to a front end of panel 34 at corner fold line 47. Flap 46 has a top edge 48 that slopes downward from, and therefore is disposed lower than, a top edge 49 of panel 34. Downward-sloping edge 48 enables wall panel 34 to slope outward, or fall back, when the box is in open format (shown by phantom lines in FIG. 8). As a result, the combination of wall panel 34 with flap 46 makes structure 30 a "fall-back side wall structure."

Fold line 47 is of special construction, which is most clearly seen in FIGS. 3 and 4. It comprises a short slit 101 at the top end followed by a series of aligned slits separated by spaces, each of the slits and spaces being approximately one-eighth inch, or three millimeters, in length. This fold line construction allows the corner of the box to be easily torn at the fold line by pushing outward against the top end of the fold line with a finger or thumb. A corner fold line, such as this one, that is constructed in such a way that it can be easily torn is referred to as an "easy-tear fold line."

A double-section V-wall structure 50 extends across the front side of bottom panel 15 and is adjacent to and disposed between opposing side wall structures 30. Structure 50, which makes up the entire front side of the carton, includes adjacent first and second V-walls 52*a* and 52*b*, respectively, which are hingedly attached to V-edges 19*a* and 19*b* by first and second V-wall fold lines (indicated by numerals 19*a* or 19*b*). Each V-wall comprises an outer panel 56(*a* or *b*) that is hingedly attached to a Vedge. An inner panel 58(*a* or *b*) is hingedly attached to a top edge of panel 56 by double-fold-lines 59 (which also indicates the top edge of panel 56). A double-fold-line is defined as two narrowly-spaced The two narrowly-spaced fold lines may be parallel, as shown in FIG. 2, double fold-line or may be slightly non-parallel, as shown in FIG. 1. Although a is shown in the embodiments, it is possible to use a single fold line in its place. The bottom edge of panel 56(*a* or *b*) is edge 19(*a* or *b*). Panel 58(*a* and *b*) has a bottom edge 60 and a panel interlock tab 61 which serves to lock the panel in place when the blank is erected into a box. It is noted that panels 56 and 58(*a* and *b*) each have a maximum height extending between top and bottom edges and that those maximum heights are approximately equal.

Unlike the inner panel of a double-panel front wall of a traditional pizza box, a substantial portion of bottom edge 60 is non-parallel to top edge 59, thereby causing inner panels 58*a* and 58*b* to be of substantially non-rectangular shape. In FIGS. 3 and 4 there is shown an imaginary outermost top line 162, which is tangential with outermost points of panels 56*a*/*b*. It is noted that, because panels 58*a*/*b* are substantially non-rectangular, no portion of those panels extends beyond line 162 by a distance of more than three-fourths of rear wall height 150. In combination with the large size of angle 120 between edges 19*a* and 19*b*, this structure enables the first embodiment to be manufactured with substantially less material than a traditional pizza box and enables the second embodiment to be manufactured with approximately the same amount of material as a traditional pizza box.

In addition, the first embodiment has a center front flap 62 hingedly attached to an inside edge of panel 56*a* at a center front flap fold line 64. In the carton format, flap 62 is disposed between inner and outer panels 56*b* and 58*b*, thereby connecting the V-walls into a center front corner.

In the second embodiment (FIGS. 2 and 4) there is a cover interlock opening 65 in panels 56*a* and 56*b*, each opening receiving a cover flap for locking the cover onto the box. In addition, an inside edge 66 of panel 56*b* is disposed at acute angle 127 to V-edge (or fold line) 19*b*, rendering panel 56*b* to be of substantially non-rectangular shape (best illustrated in FIG. 4). This configuration creates a vertical front corner on the box.

In both embodiments, a cover 70 includes a cover panel 72 hingedly attached to top edge 24 of wall 20 by a cover fold line (indicated by numeral 24) and a pair of opposing convertible cover side flap structures 74. Only the left side structure 74 is completely labeled, but the following discussion applies to the right side structure, as well. A "convertible cover side flap structure" is defined as a flap structure appended to a side edge of a cover panel and, in the box format, capable of being disposed in at least two configurations, with each of the configurations including at least one flap in the structure being held parallel to a side wall of the box.

Structure 74 includes a first side flap panel 76 hingedly attached to a side edge of cover panel 72 at a first side flap fold line 78, a second side flap panel 80 hingedly attached to a rear end of panel 76 at a fold line 82, a connecting panel 84 hingedly attached to a top edge of panel 80 and to a diagonal edge 86 of cover panel 72. In the embodiments, panel 84 has three edges: a first edge being hingedly attached to the top edge of side flap panel 80, a second edge being hingedly attached to edge 86, and a third edge 87 that is free of attachment.

In addition, both embodiments have a fallback-wall retention means as part of cover 70. In the first embodiment (FIG. 1), the fall-back-wall retention means is a cover-to-front-wall interlock flap 88 hingedly attached to a front end of panel 76 at interlock flap fold line 89, thereby making it part of convertible cover side flap structure 74. To help retain wall panel 34 in vertical position (in the carton format), flap 76 can be disposed exterior to wall 34, or outside the box cavity, with flap 88 being inserted and disposed between the inner and outer panels of the V-wall, thereby helping maintain side wall structure 30 in vertical position. It is noted that flap 88 is rounded on the inside edge to allow insertion between the panels of the V-wall. In addition, flap 88 has a height between top and bottom edges, and that height is less than a height of outer panel 56*a*/*b*, thereby enabling flap 88 to be inserted between the inner and out panels of the V-wall. A notch on the bottom edge of panel 76 allows for easy grasping of the panel when opening the box.

In the second embodiment (FIG. 2), the fallback-wall retention means is a pair of cover-to-frontwall interlock flaps 90*a* and 90*b* hingedly attached to a front edge of cover panel 72. Each of the flaps has a flap retention edge 92 which, in the closed-carton format, holds down corner flap 46 by contacting its top edge 48 (see FIG. 8), thereby helping maintain side wall structure 30 in upright position. It's noted that either form of fall-back-wall retention means can be used on either embodiment or, in other words, the first embodiment can be designed to have the fall-back-wall retention means of the second embodiment, and vice-versa. Lastly, it's noted that both forms of fall-back-wall retention means can be combined in the same embodiment.

To help hold V-walls 52*a*/*b* together at the center front corner (i.e., at their adjacent inside edges) in the carton format, the invention uses "V-wall-retention means," which is defined as one or more cover flap structures that interact with the V-walls to hold them together, or keep them from separating, at the center front corner. In the first embodiment the V-wall-retention means is side flap structure 30, or, specifically, interlock flap 88 in combination with panel 34, and in the second embodiment the retention means is interlock flaps 90*a*/*b*.

There is an imaginary outermost front line 160, which is a line that is tangential with an outermost front point of cover panel 72 and parallel with cover fold line 24. It is noted that no portion of the V-wall-retention means extends beyond line 160 by a distance of more than one-half of rear wall height 150.

A unique advantage of the invention is that the front edge of cover panel 72 can be designed into alternate contours for aesthetic and marketing purposes. This is especially the case with the cover of the first embodiment, as the entire cover front edge is free for improvisation. An example is illustrated in FIG. 11, which shows a cover panel 140 of alternate contour for the first embodiment.

Moving on, in both embodiments there is a pair of rear thermal-legs 110*a* and 110*b*, which extend from rear wall 20, and a pair of front thermal-legs 112*a* and 112*b*, which extend from outer panels 56*a* and 56*b*, respectively. Each thermal-leg has a bottom edge that has a lowermost point 114 (indicated in FIGS. 2, 3, and 4). There is a distance 116 (labeled on thermal-legs 110*a* and 112*a* in FIG. 2) that extends between lowermost point 114 and the fold line that connects the wall panel to the bottom panel. Distance 116 represents the height of the thermal-leg when the blank has been erected into a carton.

For clarity of definition, it is noted that each thermal-leg is located along a bottom panel edge and extends downward (in the carton format) from a fold line connecting a wall to the bottom panel and that that fold line extends on both sides of the thermal-leg. Accordingly, it is further noted that the length of the thermal-leg is substantially less than the length of the adjacent bottom panel edge and of the fold line that connects the wall to the bottom panel. Finally, it is noted that, in the closed-carton format, the thermal-legs assume a downward-projecting disposition which elevates bottom panel 15 above a support surface such as a table.

A unique feature of rear thermal-legs 110*a*/*b* is that they are "open-carton-retracting thermal-legs," which means that when the cover of the carton is opened, the thermal-legs change from their downward-projecting disposition to some other disposition to allow the bottom panel of the box to rest on a support surface. As applied to the embodiments, when the carton assumes an open format (with cover panel 72 and rear wall 20 laying back), the rear thermal-legs are retracted from their downward-projecting disposition and assume a horizontal position coplanar with bottom panel 15. By the thermal-legs being open-carton retracting, this enables the rear portion of bottom panel 15 to rest port surface, which makes it easier to cut pizza in the carton without crushing or bending the rear thermal-legs.

With a box loaded with hot product that's sitting on a table, the thermal-legs hold the bottom panel above the table, thereby reducing heat loss resulting from conduction through the bottom panel to the table. Because steam from the product causes the bottom panel to warp downward (a warped bottom panel being shown in FIG. 10), it's necessary that the height of the thermal-legs be sufficient to keep the bottom panel from touching the table after warping occurs. In medium-size and large-size boxes of E-flute corrugated board, the bottom panel might warp downward as much as eight millimeters, and possibly more, depending on the weight of the board and the type of pizza. Therefore, distance 116 should be at least eight millimeters and, for certain types of corrugated board, as much as ten millimeters or longer.

In addition, the bottom edge of thermal-legs 112*a* and 112*b* comprises upper and lower portions 118 and 119, respectively (shown on leg 112*b* in FIGS. 2 through 4). The purpose of lower portion 119 is to provide the desired height to the thermal-leg. The purpose of upper portion 118 is to provide a slot of proper width in panel 15 for receiving interlock tab 61, which holds inner panel 58(*a* or *b*) in place in the erected carton.

Finally, it is noted that, in the embodiments, the material used for creating the thermal-legs comes from bottom panel 15. As a result, in the carton format, panel 15 has openings 130*a*, 130*b*, 132*a*, and 132*b* (most clearly seen in FIG. 6). These are called "thermal-leg openings." With thermal-leg openings there is potential for air to flow into and out of the box cavity. In order to keep air flow to a minimal level, and thereby maintain product heat loss to a minimal level, it is necessary that the percentage of thermal-leg opening area in relation to surface area of panel 15 be small. Specifically, the total opening area should be less than ten percent of the total surface area (of one side) of panel 15. In the embodiments, the total opening area is approximately three percent of the total bottom surface area of panel 15. In addition, air flow into and out of the box cavity can be further reduced by positioning thermal-leg openings outside of the box cavity. This is accomplished by configuring side wall structure 30 so that coplanar panels 36/38 are disposed on an angle to panel 34, thereby positioning rear thermal-leg openings 130*a*/*b* outside of the box cavity (illustrated in FIG. 6).

Fold Line Angles and Alignments

The disposition of various edges and fold lines is vital to the function of the invention. The following special angles are involved.

Referring primarily to FIGS. 3 and 4, angle 120, which is disposed between the two V-edges, or fold lines, 19*a* and 19*b*, is of utmost importance. For the invention to function as intended, angle 120 must be greater than 120 degrees and less than 180 degrees, with the optimum range being between 140 degrees and 160 degrees and the ideal angle being 150 degrees, which is the angle size used in the preferred embodiments. It is at approximately 150 degrees that board savings and box performance are optimized, although any angle in the 140 to 160 degree range provides a noteworthy advantage over other similar types of cartons. In short, adjacent V-walls disposed at any angle between 140 degrees and 160 degrees, in combination with non-rectangular inner panels (58*a*/*b*) on the V-walls, can produce a double-panel pizza box that uses less material than a traditional pizza box having a double-panel wall.

Figure 5:
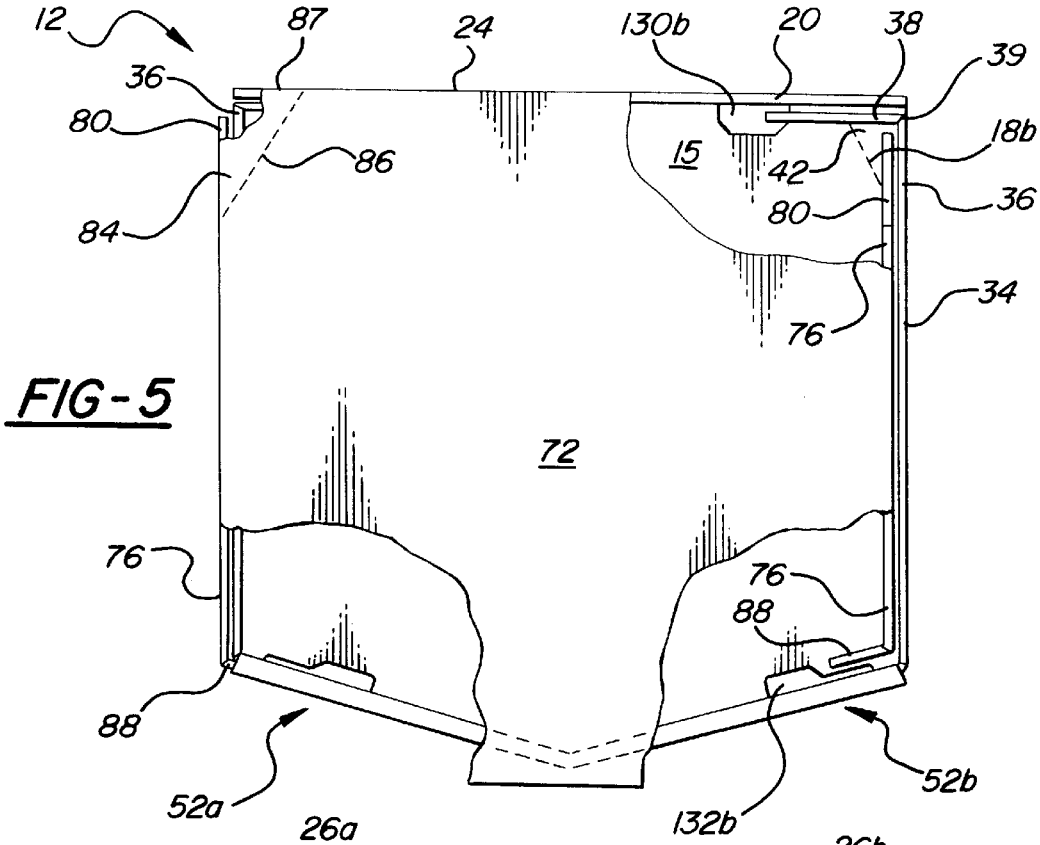
FIG. 5 is a top view of a carton formed from the blank of the first embodiment, with the side wall structure and the cover side flap structure being in first configurations and the left cover side flap being disposed exterior to the side wall and the right cover side flap being disposed interior to the side wall.
Figure 6:
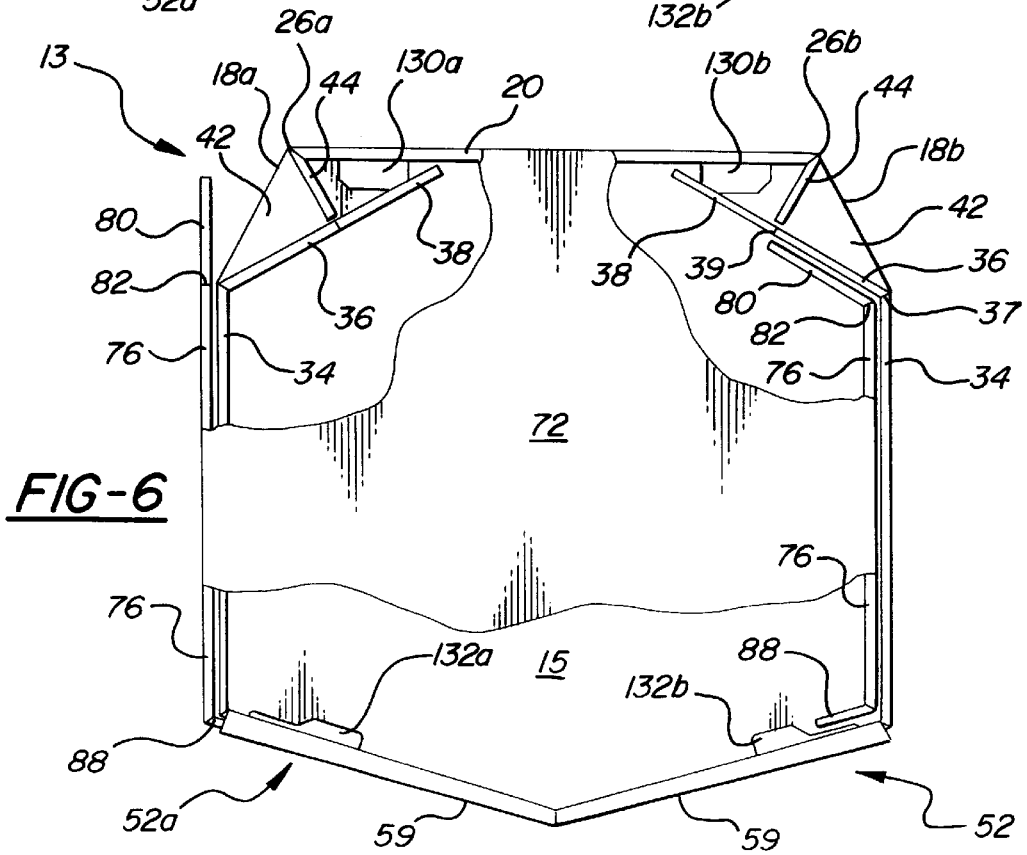
FIG. 6 is a top view of a carton formed from the blank of the first embodiment, with the side wall structures being in the second configuration and the left cover side flap structure being in the first configuration and the right cover side flap structure being in the second configuration.

As noted, angle 120 can be either interior or exterior in relation to bottom panel 15. Specifically, the angle is an interior angle in the first embodiment and an exterior angle in the second. In the carton form, the interior version is shown in FIGS. 5 and 6 and the exterior version is shown in FIGS. 8 and 9. The unique V-wall structure of the invention enables the first embodiment to be manufactured with substantially less material than a traditional pizza box and enables the second embodiment to be manufactured with approximately the same amount of material as a traditional pizza box. A key benefit of the V-wall of the second embodiment, which is referred to as an "inverted V-wall," is that it provides a large amount of space in the two front corners for packing extra items (see FIG. 9), while requiring only about the same amount of material as a traditional pizza box.

Referring to FIGS. 1 and 2, the invention also involves a special wall-angling fold line embodied in fold line 37. It is noted that line 37 is disposed at a slightly non-perpendicular angle 122 to the bottom edge of panels 34 and 36; which results in an acute angle in relation to the bottom edge of panel 36 and at an oblique angle in relation to the bottom edge of panel 34. In the carton format when wall panel 36 is disposed diagonally to wall panel 34, non-perpendicular fold line 37 causes panel 34 to be disposed at a slight inward-sloping angle, or at an angle that is more inward-sloping than the angle that would result if line 37 were disposed perpendicular to the bottom edge of panel 34. The result of non-perpendicular fold line 37 is that it produces a tighter, more rigid carton with less "side wall flare-out" than would otherwise occur with a perpendicular fold line 37.

Similarly, the invention also involves a cover-flap-angling fold line embodied in fold line 82, which is disposed at a non-perpendicular angle 124 to the top edge of panels 76 and 80; which results in an acute angle in relation to the top edge of panel 76 and at an oblique angle in relation to the top edge of panel 80. In the carton format when panel 80 is disposed diagonally to panel 76, non-perpendicular fold line 82 causes panel 76 to be disposed at an angle that is more inward-sloping than the angle that would result if line 82 were disposed perpendicular to the top edge of panel 76.

Another important structure involves fold lines, or edges, 16, 45, and 39. Specifically, these lines are "workably aligned." As used herein, the term "workably aligned" means that the blank can be folded along the selected lines in a particular configuration and it will appear that the lines are aligned, although, in fact, one line might be slightly offset from another to provide for proper folding of the box in its various configurations. The workable alignment of lines 16, 45, and 39 enables structure 30 to be convertible into any one of three wall configurations in the carton format.

The first wall configuration of structure 30 is a single side wall with a square rear corner at the rear. This is shown in carton 12 in FIG. 5, in which the side wall structures are each formed into the single wall by having panels 34 and 36 being coplanar and having panel 38 being disposed at a right angle to panel 36, thereby forming a square rear corner. In this configuration, panels 44 and 20 are coplanar and panels 42 and 15 are coplanar. It is also noted (see FIG. 1) that bottom panel 15 has a lateral front-to-rear bottom panel length 152, which is the distance between fold lines 39 and 47, or the distance between the closest portions of front and rear edges 19*a*/*b* and 16, respectively.

The second wall configuration is a side wall combined with a rear angular wall. This is shown in carton 13 in FIG. 6, in which the right side structure is formed into a combination of side and angular walls by having panels 36 and 38 being disposed coplanar and having the unitary panel formed therefrom being disposed at an angle to panel 34. In the embodiments, that angle is approximately 116 degrees. In this configuration, panel 44 is disposed at an angle to panel 20 and panel 42 overlies panel 15.

The third wall configuration is a variation of the second configuration. In this, panel 38 is folded at an angle to panel 36 and is disposed on the exterior side of panel 44. This is shown in FIG. 7.

Referring now to convertible cover side flap structure 74 (FIG. 1), it is noted that connecting panel 84 has a third (rear) edge 87 and that that edge is free of attachment (as opposed to being attached to panel 44). This structure enables structure 74 to be converted into one of two configurations in the carton format. The first configuration is a single side flap formed by having panels 76 and 80 being coplanar and having panel 84 being disposed coplanar to panel 72. The second configuration is a side flap panel combined with an angular flap panel formed by having flap 80 be disposed at an angle to flap 76, resulting in panel 84 underlying panel 72.

In addition, in the flap structure of the first embodiment, the first configuration can be further converted into two additional configurations: inside the box cavity and outside the box cavity, or interior to the side wall and exterior to the side wall. To achieve this form of convertibility, a total front-to-rear side flap panel length 154, which is the distance between fold line 89 and rear edge 81, must be at least six millimeters, or one-fourth inch, shorter than lateral front-to-rear bottom panel length 152, which is the distance between line 16 and any portion of line 19(*a* or *b*). To accomplish this, rear edge 81 is disposed forward of line 24 by approximately six millimeters.

To enhance the tightness and rigidity of the box of the first embodiment, a slightly acute angle 126 exists between fold lines 64 and 19*a* and a slightly acute angle 128 exists between fold lines 47 and 17(*a* and *b*), shown in FIG. 3. These acute angles cause the adjacent walls to angle slightly inward, thereby increasing carton rigidity. These angles are optional and right angles may be substituted in their place.

In addition, to further enhance carton tightness, the top edge of center front flap 62 angles slightly upward from the top edge of panel 56*a*.

In the second embodiment (FIG. 4), end edge 66 is disposed approximately perpendicular to edge 19*a*. As a result, edge 66 is disposed at an acute angle 127 to edge 19*b*. This configuration enables the box to have a vertical center front corner between the V-walls.

Within the context of this invention, a fold line can be created by a number of means such as, for example, by a crease or score in the board, by a series of aligned spaced short slits in the board, and by a combination of aligned spaced short and long slits. In some cases, when a longer slit is bounded on the ends by a series of shorter slits or a score, the longer slit may be slightly offset in alignment from the shorter slits or score for the purpose of creating a slot along the fold line when the blank is set up into a box. Such an offset slit may be referred to herein as a "slot-forming slit." Nonetheless, the entire combination of long and short slits is considered to constitute a single fold line unless otherwise indicated. In addition, to create a fold line where one panel is folded 180° to lay parallel on another panel, the fold line may constitute two narrowly-spaced parallel scores or series of aligned slits. In this case, the two narrowly-spaced parallel scores or series of aligned slits constitute a single fold line unless otherwise indicated. In conclusion, as referred to herein, a fold line is any line between two points on the blank or box along which the board is intended to be folded when the blank is being erected into a box. The type of fold lines shown in the drawings are presently preferred but it will be appreciated that other methods known to those skilled in the art may be used.

Operation of the Invention

As previously indicated, one of the unique features of the invention is that it can be formed into multiple carton configurations during the process of folding the blank into a box. That process is now explained. First, fold both wall panels 34 to upright position and fold corner flaps 46 inward. Second, fold panel 56*a* to upright position and fold panel 58*a* downward until tab 61 locks into the slot in bottom panel 15, thereby erecting the first V-wall with corner flap 46 enclosed between panels 56*a* and 58*a*. Third, repeat the procedure for panels 56*b* and 58*b*, thereby erecting the second V-wall.

At this point, there are three options for configuring convertible side wall structure 30, the options being referred to as first, second, and third wall configurations. For the first wall configuration, fold panel 38 inward along fold line 39, thereby forming square rear corners on the box and leaving panel 42 to be coplanar with panel 15. For the second configuration, push panel 36 inward, causing it to "flip" into an angular position to panel 34, thereby forming an angular wall extending rearward from panel 34 (leaving panels 36 and 38 to be coplanar) and causing panel 42 to overlie panel 15. For the third configuration, fold panel 38 outward along fold line 39, then push panel 36 inward as with the second configuration, resulting in a shortened angular wall extending rearward from panel 34 and causing panel 38 to be disposed on the exterior side of panel 44. The first, second, and third wall configurations are shown in FIGS. 5, 6 and 7, respectively.

An advantage of the first wall configuration is that it provides a square corner, thereby allowing space for packing a cup of dipping sauce or other item. A drawback is that it provides only one corner fold (at line 39), thereby producing minimal stacking strength. Advantages of the second configuration are that (a) it provides product containment by the angular wall, (b) it disposes the rear thermal-legs on the outside of the box cavity to reduce potential heat loss through the thermal-leg openings in the bottom panel, and (c) it provides two rear corner folds on each side (at lines 37 and 26*a*/*b*) for increased stacking strength. Advantages of the third configuration are that (a) it provides product containment by the angular wall and (b) it provides three rear corner folds on each side (at fold lines 37, 39, and 26*a*/*b*), thereby creating maximal stacking strength. As such, this configuration might be used when stacking multiple loaded cartons such as when delivering large-volume orders. A potential drawback of this configuration is that a small portion of panel 38 extends outward at the rear of the box, which might be considered unsightly.

After side wall structure 30 is formed into the desired configuration, fold cover panel 72 upright. Then fold cover side flaps 76 inward and form flap structure 74 into one of two options, the 33 options being referred to as first and second flap configurations. For the first flap configuration, which is shown in FIG. 5, leave flap 80 to be coplanar with flap 76, thereby forming a single straight cover side flap with panel 84 being disposed coplanar to panel 72. For the second configuration, which is shown on the right side of FIG. 6, fold flap 80 inward along fold line 82, thereby disposing flap 80 at an angle to flap 76 and causing panel 84 to underlie panel 72.

Note: The cartons shown in FIGS. 5 and 6 each show two different cover flap configurations, one configuration on each side of the cover panel. This arrangement is for simplicity of illustration. In reality, a box would likely have both side flaps being of the same configuration.

In the first embodiment, the first flap configuration can be further formed into two more configurations, either inside or outside of the box cavity, or interior or exterior to the side wall. In carton 12 in FIG. 5, the left cover side flap is disposed on the outside of the cavity and the right cover side flap is disposed on the inside. When the flap structure is disposed on the inside of the cavity, cover-to-front-wall interlock flap 88 is folded inward at a right angle to flap 76, thereby allowing flap structure 74 to fit within the cavity. When disposed on the outside, flap 88 is tucked between outer panel 56*a*/*b* and corner flap 46, thereby interlocking cover 70 to the V-walls and also holding flap 76 in vertical position and parallel to side wall panel 34.

As regards the first embodiment, the choice of flap configuration and its placement inside or outside of the box cavity depends on the configuration of the wall structure. With the first wall configuration (as shown in FIG. 5), the first flap configuration is recommended and it can go either inside or outside of the box cavity. With the second and third wall configurations (as shown in FIGS. 6 and 7), there are also two cover flap options. The first option is to use the first flap configuration and have it disposed outside of the box cavity (left side on carton 12, FIG. 6) and the second option is to use the second flap configuration and have it disposed inside of the cavity (right side on carton 12, FIG. 6).

It is noted, as regards the first embodiment, that in order for the first flap configuration to (a) interlock with the front corners of the box when disposed outside the box cavity and (b) fit within the front-to-rear dimension of the box cavity when disposed inside the cavity, rear edge 81 of flap structure 74 must be forward of cover fold line 24. In the embodiment, edge 81 is forward of line 24 by approximately six millimeters, or one-fourth inch.

Further regarding the first embodiment, the advantage of placing the flap structure inside of the box cavity is that the least amount of time is consumed in folding the box.

However, there is a drawback in that it results in a slightly sloppy-feeling carton as the fall-back side walls are not tightly retained in vertical position at the front corners. The advantage of placing the flap structure outside the cavity is that it results in a securely locked cover and tighter-feeling carton because the fall-back side walls are tightly retained in vertical position by the fall-back-wall retention means (i.e., flap 88 tucked into the front corners and flap 76 thereby being held vertical and parallel to panel 34).

With the second embodiment, flap structure 74 is disposed only on the inside of the box cavity. It is recommended that the first and second flap configurations be used in combination with the first and second wall configurations, respectively.

In addition, it's possible to combine the second flap configuration with the first wall configuration. This results in an opening at the rear corner of the cover. In most cases this would not be desirable; however, there may be situations where such an opening would serve a purpose, such as when extra venting to the box cavity is desired or when it would be handy to pack an item in the corner of the box and that item is taller than the height of the box.

The final step in the folding process is to engage the fall-back-wall retention means. To do this with the first embodiment in the first flap configuration, tuck flaps 88 into the front corners of the box, or between wall panels 56*a*/*b* and corner flaps 46. To engage the fall-back-wall retention means of the second embodiment, tuck cover-to-front wall interlock flaps 90*a*/*b* into openings 65 in the V-walls. Once inserted, flap-retention edge 92 contacts top edge 48 of corner flap 46 and, thereby, holds the corner flap in a position whereby fall-back wall panel 34 is caused to be retained firmly in upright position.

As previously stated, the invention includes fall-back side walls, which are made possible by the sloping top edge 48 on corner flap 46. When the box is in open format, a resilient spring-back tendency in wall panel 34 causes the wall to slope outward to the point where top edge 48 contacts fold line 59 in the V-wall, referred to as fall-back position. The advantage of the fall-back position is that it enables easy insertion of the pizza into the box and, if the pizza is cut in the box, it enables the pizza to be more easily cut therein. (It is noted that cutting the pizza in the box may result in bending front thermal-legs 112*a*/*b* and, therefore, may not be desirable.) Finally, the fall-back position facilitates removal of pizza slices by a pizza-eater.

To create a rigid, tight-feeling carton in the closed format, it's necessary to retain the fall-back side walls in vertical position. This is partially accomplished by the pressure of the cover on either the rear corner flap 38 (first wall configuration) or the angular wall panel 36/38 (second and third wall configurations) of the side wall structure. In addition, it helps to secure the front ends of panel 34 in upright position, as well. As previously explained, this is accomplished by fall-back-wall retention means, which in the first embodiment involves inserting cover-to-front-wall interlock flap 88 between the inner and outer panels of the V-wall and in the second embodiment involves inserting cover-to-front-wall interlock flaps 90*a*/*b* into opening 65 of the V-walls. It is noted that in both embodiments, the fall-back-wall retention means involves connection or interlocking of the cover structure with the front wall, or V-wall structure, of the box.

Another feature of the invention is easy-tear corners to facilitate knockdown and convenient disposal of the carton. For easy carton disposal, it's necessary to destruct the carton's corners in order to create a flattened board. To accomplish this, push firmly outward at the top end of fold line 47 with a thumb. In the first embodiment, this must also be done with center front fold line 64. The result is that the fold lines tear, or the flap separates from the wall panel, allowing the walls of the carton to lay flat, or coplanar, with the bottom panel. Subsequently, the flattened carton can be folded over once or twice and then conveniently fit into a trash receptacle.

A final feature of the invention is thermal-legs 110*a*/*b* and 112*a*/*b*, which in the carton format of the invention project downward from end wall 20 and outer panels 56*a*/*b*, respectively. The purpose of the legs is to raise bottom panel 15 above a support surface, such as a table, when the box is loaded with hot product. Testing has indicated that when a loaded pizza box sits on a relatively cold support surface, heat from the product conducts through the bottom panel and into the support surface, thereby speeding up product heat loss. By elevating the bottom panel out of contact with the support surface, product heat loss is substantially reduced. Because of the potential for downward warp in the bottom panel, it's necessary that the thermal-legs have a height that exceeds the amount of warp. In medium-size and large-size boxes, the bottom panel can warp as much as eight millimeters. Therefore, it's necessary that the height of the thermal-legs be greater than eight millimeters and, for thinner E-flute board, perhaps ten millimeters or more.

As previously stated, thermal-legs result in thermal-leg openings being created in the bottom panel of the box. To minimize the amount of air flow through the openings, the second wall configuration is recommended. With this, the angular wall created by coplanar panels 36 and 38 is disposed interior to thermal-leg openings 130*a*/*b* (most clearly seen in FIG. 6), thereby disposing the openings outside of the box cavity, which reduces air flow into the cavity.

Finally, it is noted that in the embodiments the thermal-legs are formed from material of bottom panel 15. Therefore, when the blank is erected into a box, slots are created along the front and rear edges of the bottom panel. In the case of the front thermal-legs, the slots also serve the purpose of retaining tab 61, and thereby inner panels 58*a*/*b*, in place. To accomplish this, it is necessary that at least a portion of the slot be of such width that it will properly retain tab 61. Therefore, the bottom edge of the front thermal-legs have upper and lower portions 118 and 119, respectively. The purpose of the lower portion is to provide adequate height to the thermal-legs and the purpose of the upper portion is to create a slot of the proper width for holding tab 61. The optimum dimension for that width is approximately five millimeters for E-flute board and six millimeters for B-flute. Finally, it is noted that when the box is in open format, rear wall 20 is caused to lay back or flat on a support surface. This, in turn, causes rear thermal-legs 110*a*/*b* to also lay flat, or to assume a coplanar disposition with bottom panel 15. Thermal-legs that change from their downward-projecting disposition to some other disposition to allow the bottom panel of a box to rest on a support surface are called open-carton-retracting thermal-legs. This enables a pizza to be cut in the carton without the thermal-legs being bent or crushed.

CONCLUSION, RAMIFICATIONS, AND SCOPE

I have disclosed a multi-function blank and corresponding pizza box that embodies one or more of the following unique structures: (a) a double-section V-wall structure that can be configured at a particular angle that provides substantial material savings or at an angle that provides extra box cavity space without requiring extra material, (b) convertible side wall and cover flap structures that can be formed into a variety of configurations to achieve a variety of functional advantages, (c) fallback side walls that provide easy product insertion and retrieval in combination with fall-back-wall retention means that helps hold the side walls in vertical position, (d) a wall-angling fold line that creates greater carton tightness and rigidity, (e) an easy-tear corner flap fold line that provides easy carton knockdown and disposal, and (f) thermal-legs that enhance product heat retention.

The illustrated number, size, shape, type, and placement of components represent the preferred embodiment; however, many other combinations and configurations are possible within the scope of the invention. Examples of some alternate configurations are described below.

In the carton format of the embodiments, the angle between the angular wall (panel 36) and the side wall (panel 34) in the second and third configurations is approximately 116 degrees. However, other angles may be used and, if applied, would be considered to be within the scope of the invention.

The third wall panel 38 is optional in that it can be omitted, if desired, and the box will still perform, although it might not be as tight as the preferred embodiments. Omission of panel 38 would be considered within the scope of the invention.

It is noted that either form of fall-back-wall retention means can be used on either embodiment or, in other words, the first embodiment can be designed to have the fall-back-wall retention means of the second embodiment, and vice-versa. Also, both forms of fall-back-wall retention means can be used on the same embodiment.

Throughout the discussion, reference was made to packaging pizza. However, it is noted that my invention can be used for packaging other foods and for other applications, as well.

In conclusion, it is understood that my invention is not to be limited to the disclosed embodiments but, on the contrary, is intended to cover various modifications and equivalent arrangements included within the spirit and scope of the appended claims.

I claim:

1. A blank for a box having a V-wall structure, said blank being of foldable material cut and scored to define:

a bottom panel having a plurality of edges including adjacent first and second V-edges disposed at a predetermined angle greater than 120 degrees and less than 180 degrees;

a plurality of walls and wall structures hingedly attached to said bottom panel, including a double-section V-wall structure comprising adjacent double-panel first and second V-walls, each of the V-walls comprising an outer panel hingedly attached to one of said first and second V-edges and an inner panel hingedly attached to a top edge of said outer panel, at least one of the inner panels being substantially non-rectangular;

whereby after the blank has been erected into a box said double-section V-wall structure comprises adjacent first and second double-panel walls disposed at an angle greater than 120 degrees and less than 180 degrees.

2. The blank of claim 1 wherein:

said predetermined angle is greater than 140 degrees and less than 160 degrees.

3. The blank of claim 1 wherein:

said predetermined angle is an interior angle of said bottom panel.

4. The blank of claim 1 wherein:

said predetermined angle is an exterior angle of said bottom panel.

5. The blank of claim 1 wherein:

the outer panel of at least one of said first and second V-walls has an inside end edge disposed at an acute angle to one of said first and second V-edges.

6. The blank of claim 1 wherein:

said first and second V-edges together comprise a front side of said bottom panel, said plurality of edges further includes first and second side edges disposed adjacent said first and second V-edges, respectively, and a rear edge disposed opposite said first and second V-edges;

said plurality of walls and walls structures further includes a rear wall hingedly attached to said rear edge;

said blank further comprises a cover hingedly attached to said rear wall at a cover fold line.

7. The blank of claim 6 wherein:

said first and second side edges are parallel.

8. The blank of claim 6 wherein:

said cover comprises a cover panel and V-wall-retention means hingedly attached to said cover panel, whereby after the blank has been erected into a closed box the V-wall-retention means interlocks with said V-wall structure and increases the rigidity of the box.

9. The blank of claim 8 wherein:

said cover panel has an outermost front line which is defined as an imaginary line that is parallel to said cover fold line and is tangential with an outermost front point of said cover panel;

said rear wall has a predetermined height which is defined as the distance between said rear edge and said cover fold line;

no portion of said V-wall-retention means extends beyond the outermost front line by a distance of more than one-half said predetermined height.

10. The blank of claim 9 wherein:

each of the outer panels has an outermost point along its top edge;

said blank further comprises an outermost top line which is defined as an imaginary line that is tangential with the outermost point of each of the outer panels;

no portion of each of the inner panels extends beyond the outermost top line by a distance of more than three-fourths of said predetermined height.

11. A blank for a box having a fall-back side wall structure and a fall-back-wall retention means, said blank being of foldable material cut and scored to define:

(a) a bottom panel;

(b) a plurality of walls and wall structures hingedly attached to said bottom panel and including:

(i) a rear wall, (ii) a first fall-back side wall structure comprising a side wall panel and a free-swinging corner flap hingedly attached to a front end of the side wall panel, said free-swinging corner flap having a flap top edge disposed lower than a top edge of said side wall panel, (iii) a double-panel front wall structure disposed opposite said rear wall and adjacent said first fall-back side wall structure and comprising an outer panel hingedly attached to said bottom panel and an inner panel hingedly attached to a top edge of said outer panel at a fold line, whereby after the blank has been erected into a box the corner flap is disposed between said inner and outer panels and said side wall panel is movable from a vertical position to a fall-back position and is held in said fall-back position by said flap top edge contacting said fold line;

(c) a cover hingedly attached to said rear wall and comprising a cover panel and at least one fall-back-wall retention means hingedly attached to said cover panel, whereby after the blank has been erected into a closed box said fall-back-wall retention means interlocks with said double-panel front wall structure and holds said first fall-back side wall in the vertical position.

12. The blank of claim 11 wherein:

said fall-back-wall retention means comprises a first side flap hingedly attached to a side edge of said cover panel and a cover-to-front-wall interlock flap hingedly attached to a front end of said first side flap, whereby after the blank has been erected into a closed box said first side flap is disposed exterior and parallel to said side wall panel and said cover-to-front-wall interlock flap is disposed between the inner and outer panels of said double-panel front wall structure, thereby holding said side wall panel in the vertical position.

13. The blank of claim 11 wherein:

said fall-back-wall retention means comprises a first cover front flap hingedly attached to a front edge of said cover panel and having a flap retention edge, whereby after the blank has been erected into a closed box said first cover front flap is disposed within an opening in said front wall structure and said flap retention edge of the cover front flap contacts said flap top edge of the corner flap, thereby holding said side wall panel in the vertical position.

14. A blank for a box having a convertible side wall structure, said blank being of foldable material cut and scored to define:

(a) a bottom panel having a side edge, an angular edge, and an end edge;

(b) a plurality of walls and wall structures including an end wall hingedly attached to said end edge and a first convertible side wall structure comprising:

(i) a first wall panel hingedly attached to said side edge, (ii) a second wall panel hingedly attached to an end of said first wall panel at a first fold line and having a panel end edge, (iii) a first connecting panel hingedly attached to a bottom edge of said second wall panel, (iv) a second connecting panel hingedly attached to said first connecting panel at a third fold line and to an end of said end wall, wherein said panel end edge, said third fold line, and said end edge of the bottom panel are workably aligned, whereby:

when the blank is being folded into a box, said convertible side wall structure can be formed into either of first and second configurations, the first configuration being a single side wall and the second configuration being a side wall with an angular wall extending therefrom, the first configuration being formed by leaving the first and second wall panels to be coplanar to form the single side wall, resulting in the first connecting panel being disposed coplanar with the bottom panel and the second connecting panel being disposed coplanar with the end wall, the second configuration being formed by folding the second wall panel at an angle to the first wall panel along the first fold line to form angular and side walls, respectively, resulting in the first connecting panel being disposed in overlying position to the bottom panel and the second connecting panel being disposed at an angle to the end wall and extending from the end wall toward the angular wall.

15. The blank of claim 14 further comprising:

a third wall panel hingedly attached to the panel end edge of said second wall panel, whereby when the blank is being folded into a box the third wall panel can be (a) folded inward at a right angle to the second wall panel to form a square end corner in the first configuration, or (b) left coplanar with the second wall panel to form a full-length angular wall in the second configuration, or (c) formed into a third configuration by folding the third wall panel outward at a right angle to the second wall panel and positioning it exterior to the second wall panel.

16. A blank for a box having a convertible wall adjacent a double-panel wall, said blank being of foldable material cut and scored to define:

a bottom panel having adjacent first and second edges and a plurality of walls and wall structures including:

(a) a convertible wall structure comprising:

(i) a first wall panel hingedly attached to said first edge, (ii) a second wall panel hingedly attached to a first end of said first wall panel, (iii) a first connecting panel hingedly attached to a bottom edge of said second wall panel, (iv) a second connecting panel hingedly attached to said first connecting panel, (v) a corner flap hingedly attached to a second end of said first wall panel;

(b) a double-panel wall structure disposed adjacent the second end of said first wall panel and comprising an outer panel hingedly attached to said second edge and an inner panel hingedly attached to a top edge of said outer panel;

whereby after the blank has been erected into an open box said corner flap is disposed between said inner and outer panels, thereby forming a corner, and said convertible wall structure can be formed into either one of first and second configurations, the first configuration being a single side wall with the first and second wall panels being coplanar and the second configuration being a side wall with an angular wall extending therefrom.

17. The blank of claim 16 wherein:

said second edge is disposed at a non-perpendicular angle to said first edge.

18. A box having an improved wall structure, said box comprising:

(a) a bottom panel having non-adjacent first and second edges;

(b) a plurality of walls and wall structures including a first wall hingedly attached to said first edge and a convertible side wall structure comprising:

(i) a first wall panel hingedly attached to said second edge, (ii) a second wall panel hingedly attached by a first corner fold line to an end of said first wall panel and disposed at an angle thereto, (iii) a first connecting panel hingedly attached to a bottom edge of said second wall panel and overlying said bottom panel, (iv) a second connecting panel hingedly attached by a second corner fold line to said first connecting panel and to an end of said first wall and disposed at an angle thereto, (v) a third wall panel hingedly attached by a third corner fold line to an end of said second wall panel and disposed at an angle thereto, said third wall panel being disposed on an exterior side of said second connecting panel.

19. A blank for a box having a convertible cover side flap structure, said blank being of foldable material cut and scored to define:

(a) a bottom panel having rear, side, and front edges;

(b) a plurality of walls and wall structures hingedly attached to said bottom panel and including rear and side walls hingedly attached to said rear and side edges, respectively;

(c) a cover comprising a cover panel hingedly attached to said rear wall at a cover fold line and a first convertible cover side flap structure hingedly attached to a side edge of said cover panel, said first convertible cover side flap structure including at least one side flap panel;

whereby after the blank has been erected into a box said first convertible cover side flap structure can be disposed in first and second configurations and in each configuration said at least one side flap panel is held approximately parallel to said side wall.

20. The blank of claim 19 wherein:

said bottom panel has a predetermined lateral front-to-rear bottom panel length extending between said front and rear edges;

said plurality of walls and wall structures further includes a double panel front wall structure comprising an outer panel hingedly attached to said front edge and an inner panel hingedly attached to a top edge of said outer panel;

said first convertible cover side flap structure comprises:

(a) a side flap panel structure having front and rear ends and a predetermined front-to-rear side flap panel length extending between said front and rear ends, (b) a corner interlock flap hingedly attached to the front end of said side flap panel structure;

wherein said predetermined front-to-rear side flap panel length is at least six millimeters shorter than said predetermined lateral front-to-rear bottom panel length, whereby:

when the blank is being folded into a box, said first convertible cover side flap structure can be formed into either one of the first and second configurations, the first configuration being the side flap panel structure disposed on the inside of said side wall and the second configuration being the side flap panel structure disposed on the outside of said side wall, the first configuration being formed by folding the corner interlock flap inward at right angle to the side flap panel structure and placing the first convertible cover side flap structure inside the box when closing the cover, the second configuration being formed by placing the first convertible cover side flap structure outside the box when closing the cover and then inserting the corner interlock flap between the inner and outer panels of the double-panel front wall.

21. The blank of claim 19 wherein:

said first convertible cover side flap structure comprises:

(a) a first side flap panel hingedly attached to a side edge of said cover panel, (b) a second side flap panel hingedly attached to a rear end of said first side flap panel at a fold line and having a panel rear edge, (c) a connecting panel having first, second, and third edges and hingedly attached to a top edge of said second side flap panel at the first edge and to said cover panel at the second edge, the third edge being free of attachment;

whereby:

when the blank is being folded into a box, said first convertible cover side flap structure can be formed into either one of the first and second configurations, the first configuration being a single side flap and the second configuration being a side flap with an angular flap extending therefrom, the first configuration being formed by leaving the first and second side flap panels to be coplanar to form the single side flap, resulting in the connecting panel being disposed coplanar with the cover panel, the second configuration being formed by folding the second side flap panel at an angle to the first side flap panel along the fold line to form angular and side cover flaps, respectively, resulting in the connecting panel being disposed in underlying position to the cover panel.

22. The blank of claim 21 wherein:

the panel rear edge of the second side flap panel is disposed on the cover panel side of the cover fold line, whereby when the blank is being folded into a box and the convertible cover side flap structure is folded into the first configuration the flap structure will fit within the box.

23. A blank for a box having at least one easy-tear corner, said blank being of foldable material cut and scored to define:

(a) a bottom panel having adjacent first and second edges;

(b) a plurality of walls and wall structures including a double-panel wall structure hingedly attached to said first edge and another wall structure hingedly attached to said second edge and comprising:

(i) a wall panel, (ii) a corner flap hingedly attached to an end of said wall panel by an easy-tear fold line, wherein said easy-tear fold line comprises a series of aligned slits separated by spaces and includes a short slit at a top end of the fold line;

whereby after the blank has been erected into a box and the corner flap is enclosed between inner and outer panels of the double-panel wall to form a corner said corner can be easily destructed by pushing outward at the top end of the fold line with a finger or thumb.

24. A blank for a box having at least one wall-angling fold line between walls, said blank being of foldable material cut and scored to define:

(a) a bottom panel;

(b) a plurality of walls and wall structures including:

(i) a first wall hingedly attached to said bottom panel at a first fold line, (ii) a second wall hingedly attached to an end of said first wall panel at a second fold line, wherein said second fold line is non-perpendicular to said first fold line;

whereby after the blank has been erected into a box and said second wall is disposed at an angle to said first wall, one of the first and second walls is caused to slope farther inward than would occur if the second fold line were disposed perpendicular to the first fold line.

25. The blank of claim 24, further comprising:

a connecting panel hingedly attached to a bottom edge of said second wall.

26. A blank for a box having at least one thermal-leg, said blank being of foldable material cut and scored to define:

a bottom panel having first, second, and third edges;

a plurality of walls including a first wall hingedly attached to the first edge along a first fold line;

a first thermal-leg projecting inward into said bottom panel from said first fold line and having a bottom edge having a lowermost point;

a predetermined distance between said lowermost point and said first fold line, said predetermined distance being greater than eight millimeters;

whereby after the blank has been erected into a box and loaded with hot product and placed on a table, the thermal-leg helps hold the entire bottom panel of the box above the table, thereby eliminating conductive heat transfer that would occur if the bottom panel were in contact with the table.

27. The blank of claim 26 wherein:

said third edge extends at an angle from said second edge toward said first edge;

said first thermal-leg is disposed near said third edge;

said blank further comprises:

(a) a second wall hingedly attached to the second edge and having an end adjacent said first wall, (b) a third wall hingedly attached to said end, (c) a connecting panel hingedly attached to a bottom edge of said third wall;

whereby after the blank has been erected into a box the third wall is disposed diagonally between the first and second walls, the connecting panel overlies the bottom panel, and at least a portion of a thermal-leg opening formed from the thermal-leg is disposed outside of a box cavity formed by the bottom panel and plurality of walls.

28. The blank of claim 26, further comprising:

a third wall hingedly attached to said bottom panel at a second fold line;

a second thermal-leg projecting inward into said bottom panel from said second fold line and having a bottom edge having a lowermost point;

a predetermined distance between said lowermost point and said second fold line;

the predetermined distance between the bottom edge of each of the first and second thermal-legs and the first and second fold lines, respectively, being greater than ten millimeters.

29. The blank of claim 28 wherein:

the bottom edge of at least one of the first and second thermal-legs has upper and lower portions.

30. A hot food carton having at least one thermal-leg, said hot food carton comprising:

a bottom panel having a plurality of edges including first and second edges, each edge having a predetermined length;

a plurality of walls;

a first thermal-leg located along said first edge and having a predetermined length, the predetermined length of the first thermal-leg being substantially less than the predetermined length of the first edge, said first thermal-leg being in downward-projecting disposition and having a bottom edge having a lowermost point;

a first thermal-leg opening in said bottom panel;

a predetermined distance between said lowermost point and said bottom panel, said predetermined distance being greater than eight millimeters;

whereby when said carton is loaded with hot product and placed on a table, the thermal-leg helps hold the entire bottom panel of the carton above the table, thereby eliminating conductive heat transfer that would occur if the bottom panel were in contact with the table.

31. The carton of claim 30:

wherein said carton has a carton cavity formed by the bottom panel and plurality of walls and at least a portion of said first thermal-leg opening is disposed outside of said carton cavity.

32. The carton of claim 30 wherein:

said carton has a carton cavity formed by the bottom panel and plurality of walls;

a bottom surface of said bottom panel has a total bottom surface area;

said bottom panel has a total thermal-leg opening area;

said total thermal-leg opening area is less than ten percent of said total bottom surface area, whereby air flow into and out of the carton cavity is maintained at a minimal level.

33. The carton of claim 30 wherein:

said first thermal-leg is an open-carton-retracting thermal-leg, whereby when a cover on said carton is opened the thermal-leg is retracted from its downward-projecting disposition, thereby enabling the bottom panel of the carton to rest upon a support surface such as a table.

34. The carton of claim 30, further comprising:

a second thermal-leg located along said second edge, said second thermal-leg being in downward-projecting disposition and having a bottom edge having a lowermost point;

a predetermined distance between said lowermost point and said bottom panel;

the predetermined distance between the bottom edge of each of the first and second thermal-legs and the bottom panel being greater than ten millimeters.

35. The carton of claim 34 wherein:

the bottom edge of at least one of the first and second thermal-legs has upper and lower portions.

36. In a closed box having a cover panel, rear wall panel, front wall panel, and fall-back side wall structure disposed adjacent said front wall panel and comprising a fall-back side wall and a corner flap hingedly attached to an end of said fall-back side wall, said fall-back side wall being defined as a side wall panel that moves from an upright position to a fall-back position when said box is opened, an improvement comprising:

a fall-back-wall retention means comprising a side flap hingedly attached to a side edge of said cover panel and an interlock flap hingedly attached to a front end of said side flap, said side flap being disposed on an exterior side of said fall-back side wall and said interlock flap being disposed between said front wall panel and a front end of said fall-back side wall, whereby said fall-back side wall is at least partially held in said upright position by said side flap and said side flap is held in a downward position by said interlock flap being frictionally engaged between said front wall panel and the front end of said fall-back side wall.

* * * * *